US005349428A

United States Patent [19]

Derrick

[11] Patent Number: 5,349,428

[45] Date of Patent: Sep. 20, 1994

[54] CLEANING APPARATUS FOR THE REDUCTION OF BLADE TUCK IN REMOVAL OF SPOT-CAUSING AGGLOMERATE PARTICLES

[75] Inventor: John F. Derrick, Williamson, N.Y.

[73] Assignee: Xerox Corporation, Stamford, Conn.

[21] Appl. No.: 145,558

[22] Filed: Nov. 4, 1993

[51] Int. Cl.[5] ..... G03G 21/00

[52] U.S. Cl. ..... 355/299; 118/652; 15/256.5; 15/100

[58] Field of Search ..... 355/296–299; 118/652; 15/93.1, 100, 97.1, 256.51, 256.5

[56] References Cited

U.S. PATENT DOCUMENTS

| | | | |
|---|---|---|---|
| 4,247,196 | 1/1981 | Ogawa et al. | 355/299 |
| 4,989,047 | 1/1991 | Jugle et al. | 355/297 |
| 5,031,000 | 7/1991 | Pozmakos et al. | 355/297 |
| 5,168,309 | 12/1992 | Odachi et al. | 355/219 |
| 5,237,374 | 8/1993 | Ueno et al. | 355/299 |
| 5,238,495 | 8/1993 | Madrzak | 355/299 X |

FOREIGN PATENT DOCUMENTS

| | | | |
|---|---|---|---|
| 143149 | 11/1979 | Japan | 355/299 |
| 235985 | 9/1989 | Japan | 355/299 |
| 235981 | 10/1991 | Japan | 355/299 |

OTHER PUBLICATIONS

Xerox Disclosure Journal, Author: John F. Derrick Entitled "Adjustment Free and Easily Removable Spots Blade Bracket", Published in the Jul./Aug. 1993 Edition, vol. 18, No. 4.

*Primary Examiner*—Matthew S. Smith
*Attorney, Agent, or Firm*—Leslie A. Weise

[57] ABSTRACT

A thin scraper blade member is arranged in interference with, and at a low angle of attack with respect to the photoreceptor so that a maximum shearing force can be applied by the blade to the spot-causing agglomerate particles for removal thereof. A slit extends laterally from one side of the blade and parallel to the edge of the blade, so that blade tuck occurrence is minimized. The slits serve to reduce the load and eliminate forces on the ends of the blade that cause the blade to tuck under. The slit also improves the range of tolerance of interference of the blade surface with respect to the photoreceptor surface before blade tuck occurs. A relatively low load is applied to the blade, so that the problems associated with the frictional sealing contact that must occur in the normal cleaning engagement of blades with a charge retentive surface are avoided.

22 Claims, 4 Drawing Sheets

CLEANING APPARATUS FOR THE REDUCTION OF BLADE TUCK IN REMOVAL OF SPOT-CAUSING AGGLOMERATE PARTICLES

FIELD OF THE INVENTION

This invention relates to reproduction apparatus and more particularly to a cleaning apparatus for removing residual toner and debris from a charge retentive surface including a secondary cleaning system for release and removal of agglomerate particles from the surface that are not cleaned therefrom at the primary cleaner.

BACKGROUND OF THE INVENTION

In electrophotographic applications such as xerography, a charge retentive surface (i.e. photoconductor, photoreceptor, or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways. Ion projection devices where a charge is imagewise deposited on a charge retentive substrate operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed in automatic xerographic devices utilizes a brush with soft conductive fiber bristles which have suitable triboelectric characteristics. While the bristles are soft they are sufficiently firm to remove residual toner particles from the charge retentive surface. A voltage is applied to the fibers to enhance removal of toner from the charge retentive surface.

However, not all toner and debris is removed from the surface by the brush cleaner. It has been found that toner particles agglomerate with themselves, and with certain types of debris to form a spot-wise deposition that can eventually strongly adhere to the charge retentive surface. These spots range from 50 μm to 500 μm in diameter, but typically are about 200 μm in diameter. The agglomerate particles range in material compositions from strictly toner to a broad assortment of toner, and plastics and debris from paper. The spots cause a copy quality defect showing up as a black spot on a background area of the copy which is the same size as the spot on the photoreceptor. The spot on the copy varies slightly with the exact machine operating conditions, but cannot be deleted by control of the the machine process characteristics. The presence of agglomerate spots tends to be particularly predominant with the use of recycled-content paper in a reproduction apparatus, as more paper debris is often present on recycled-content paper than on non-recycled content paper. Also, the need for effective agglomerate spot removal may be more critical with use of recycled-content paper because preexisting spots often appear on the surface of this type of paper which remain after the image has been transferred. In studying the formation of these spots, it was noted that most of the spots appeared instantaneously on the charge retentive surface, i.e., most spots were not the result of a continuing nucleation process. It was subsequently noted that newly deposited spots were more weakly adhered to the surface than older spots.

Agglomerate spot cleaning blades ("spots blades") have been used for removal of agglomerate particles from a charge retentive surface, wherein a relatively lower load is applied to the blade so that the various problems associated with the frictional sealing contact that must occur in the normal cleaning engagement of blades with a charge retentive surface are avoided.

Upon insertion of a new blade into an electrophotographic device, however, high frictional forces are noted during a break in period, until the blade is properly lubricated. A fixed blade is prone to "tuck" under during break in, or startup, because the dynamic friction forces established between the moving photoreceptor and blade create a bending moment which further increases the normal force on the blade. Blade tuck is predominant when the blade is in the doctoring or scraper mode where the cleaning blade edge acts to scrape, or "shear" agglomerate particles from the photoconductive belt surface.

When blade tuck occurs, the increased force on the blade results in increased pressure of the blade on the photoconductive belt, causing wear marks and scratches on the charge retentive surface. These deleterious effects of blade tuck reduce the life expectancy of the photoconductive belt or the spots blade. For example, testing of reproduction apparatus having an agglomerate spot cleaning blade (without incorporation of the present invention) and where blade tuck had occurred, has shown to reduce the number of cycles before photoreceptor belt failure from 500,000 to 50,000. The occurrence of blade tuck also results in an increased necessity for unscheduled maintenance due to either photoreceptor belt failure, blade failure, or by machine failure which may occur, particularly if a separate or lower power drive motor is used on the photoreceptor belt.

The following disclosures may be relevant to various aspects of the present invention and may be briefly summarized as follows:

U.S. Pat. No. 4,989,047 issued to Jugle et al. discloses an apparatus for cleaning an electrophotographic printer imaging surface. The cleaning apparatus includes a primary cleaner device in combination with a secondary cleaning device. The secondary cleaning device consists of a blade holder pivotally connected to the housing. The blade holder holds a cleaning blade in frictional contact with the imaging surface, arranged at a low angle of attack and to which a relatively low load is applied for the removal of toner and other debris agglomerates.

U.S. Pat. No. 5,031,000 issued to Pozniakas is a Continuation-In-Part of U.S. Pat. No. 4,989,047, and discloses a floating support assembly which enables the secondary cleaning blade to float relative to the charge retentive surface. This floating support assembly is loaded with a weight selected to maintain the blade in contact with the charge retentive surface, and has a stop to limit the range of movement of the floating blade, so that blade creep is prevented. Blade creep is defined as the tendency of the blade to slide under the loading weight to a position where the angle of attack is approximately 0°, and is no longer effective.

U.S. Pat. No. 5,168,309 issued to Adachi et al. discusses the problem of blade "burring" (described as a force tending to turn up the edge of the blade) on a cleaning blade and especially on a contact charging blade (used for charging the photosensitive member in place of a corona discharger), and its negative effect on the attempt of the contact charging blade to achieve uniformity of charge over the surface of an image bearing member. This patent proposes a contact charging blade wherein the frictional coefficient of that portion of the blade which contacts the photosensitive member is at a decreased level so that burring of the blade is prevented. To accomplish this objective, the following alterations to the blade composition and characteristics are disclosed: a sheet layer of low friction coefficient material attached to the contact side of the contact charging blade; a finely roughened contact side of a molded, conductive rubber blade surface which reduces the contact surface area of the blade to the photosensitive member; and a molded, conductive rubber blade surface, wherein a parting agent remaining on the contact side of the blade has lubricating property and is utilized to reduce the frictional coefficient of the blade with respect to the photosensitive member.

SUMMARY OF THE INVENTION

In accordance with the invention, and in accordance with one aspect of the invention, there is provided an improved printing machine of the type having a means for recording a latent image on a surface and a means for developing the latent image with toner. The improvement comprises a blade which is interposed between the recording means and the developing means, and which has a free edge adapted to engage with the surface to remove at least residual toner therefrom. The blade includes a region of increased flexibility extending inwardly from one side of the blade, and in a direction substantially parallel to the edge of the blade so as to substantially prevent the occurrence of blade tuck.

Pursuant to another aspect of the invention, a cleaning apparatus is provided for the removal of spot causing agglomerate particles from a charge retentive surface comprising a blade having a free edge adapted to engage with the surface. The blade includes in a region of increased flexibility, a slit extending inwardly from one side of the blade and in a direction substantially parallel to the edge of the blade, so as to substantially prevent the occurrence of blade tuck.

DETAILED DESCRIPTION OF THE DRAWINGS

While the present invention will hereinafter be described in connection with a preferred embodiment, it will be understood that it is not intended to limit the invention to that embodiment. On the contrary, it is intended to cover all alternatives, modifications, and equivalents, as may be included within the spirit and scope of the invention as defined by the appended claims.

Figure 1:
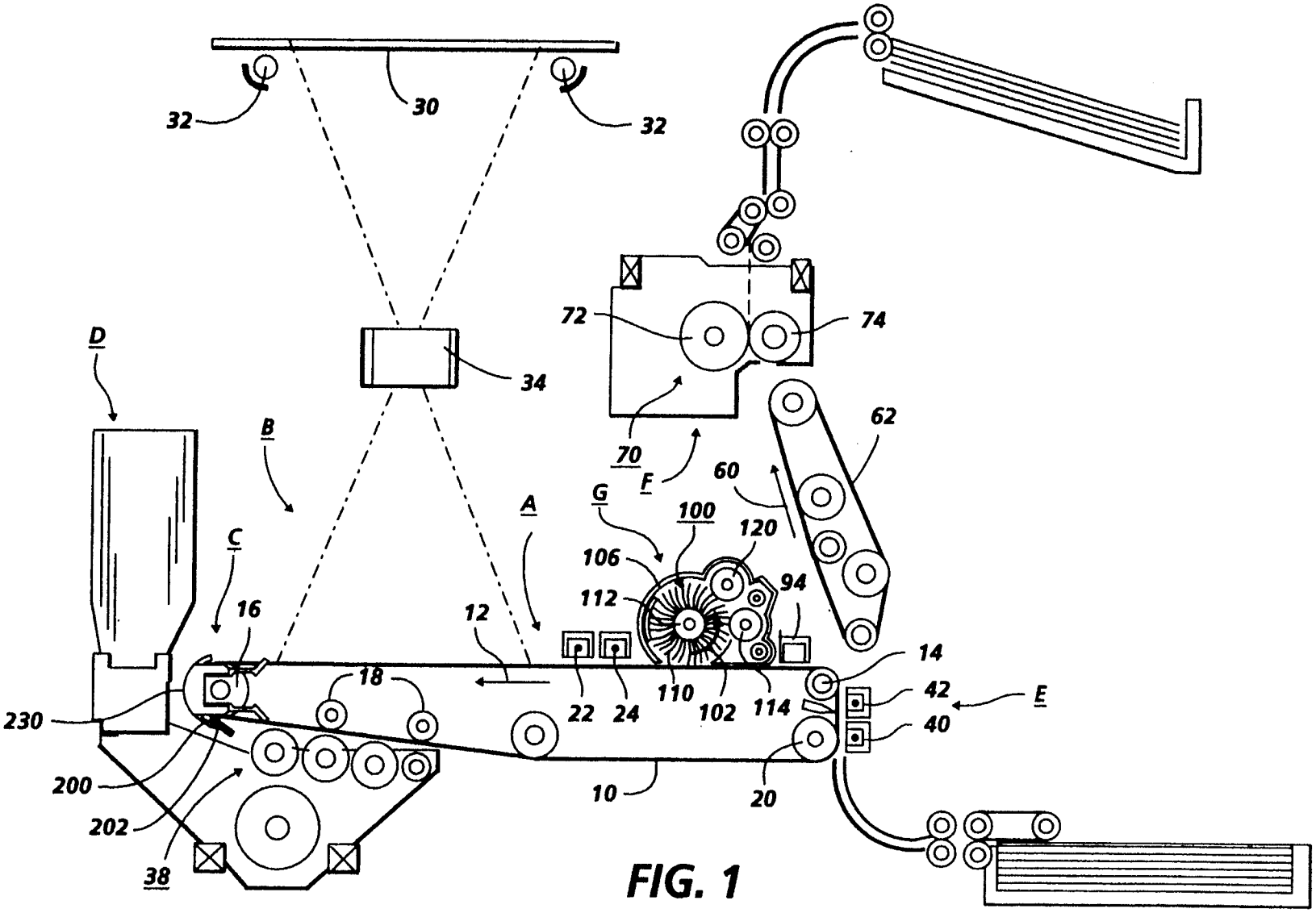
FIG. 1 is a schematic elevational view depicting an electrophotographic printing machine incorporating the present invention.

For a general understanding of the features of the present invention, reference is made to the drawings where like reference numerals have been used throughout to identify identical elements. FIG. 1 will be described only briefly. It will no doubt be appreciated that the various processing elements also find advantageous use in electrophotographic printing applications from an electronically stored original, in apparatus having both printing and copying capabilities, or, with appropriate modifications, to an ion projection device which deposits ions in image configuration on a charge retentive surface.

A reproduction machine in which the present invention finds advantageous use utilizes a photoreceptor belt 10 having a photoconductive (or imaging) surface. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive. Belt 10 is maintained in tension by a pair of springs 222 (shown in FIG. 4) resiliently urging tension roller 16 against belt 10 with the desired spring force. Both stripping roller 18 and tension roller 16 are rotatably mounted. These rollers are idlers which rotate freely as belt 10 moves in the direction of arrow 12.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. An electrostatic latent image is then recorded on the belt which corresponds to the informational area contained within the original document. It will also be understood that the light lens imaging system can easily be changed to utilize, rather, a laser to imagewise discharge the photoreceptor in accordance with stored electronic information.

The belt then passes the dirt shield bracket assembly 230 at station C having the spots blade 200 and blade holder 202 located within. At dirt shield station C, bracket 230 blocks air having toner and debris from development station D. The spots blade 200 located within bracket 230 and in contact with photoreceptor belt 10 serves to shear spot causing agglomerate particles from the photoreceptor belt surface. Aspects of these components of station C are discussed later in greater detail.

Thereafter, belt 10 advances the electrostatic latent image to development station D. At development station D, a magnetic brush developer unit 38 advances a developer mix (i.e. toner and carrier granules) into contact with the electrostatic latent image. The latent image attracts the toner particles from the carrier granules, thereby forming toner powder images on photoreceptor belt 10.

Belt 10 then advances the developed latent image to transfer station E. At transfer station E, a sheet of support material such as a paper copy sheet is moved into contact with the developed latent image on belt 10. After transfer, the sheet continues to move in the direction of arrow 60 onto a conveyor 62 which advances the sheet to fusing station F.

Fusing station F includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

A pre-clean corona generating device 94 is provided for exposing the residual toner and contaminants (hereinafter, collectively referred to as toner) to positive charges to thereby narrow the charge distribution thereon for more effective removal at cleaning station G. It is contemplated that residual toner remaining on photoreceptor belt 10 after transfer will be reclaimed and returned to the developer station D by any of several well known reclaim arrangements, and in accordance with the arrangement described below, although selection of a non-reclaim option is possible.

With continued reference to FIG. 1, cleaning station G includes a fiber brush cleaning arrangement having dual detoning rolls, provided for the removal of residual toner and debris from belt 10. A captive fiber cleaning brush 100 is supported for rotational movement in the direction of the arrow 102 via a motor (not shown), within a cleaning housing 106, and negatively biased by a D.C. power source (not shown). As described in U.S. Pat. No. 3,572,923, a fiber brush may advantageously comprise a large number of conductive cleaning fibers 110 supported on a cylindrical conductive member 112. Residual toner and contaminants or debris such as paper fibers and Kaolin are removed from the photoreceptor belt 10 surface by means of a brushing action of the fibers 110 against belt 10 and the electrostatic charge applied to the fibers from by the D.C. power supply. In a xerographic system of the type disclosed herein, brush 100 will remove both toner and debris from the photoreceptor, the former having a positive and the latter typically having a negative charge. Negatively charged contaminants are removed along with the positively charged toner particles to which they may be adhered.

Recesses in cleaning housing are provided for support of the detoning rolls 114 and 120 therein, as well as for blade and auger arrangements (not shown) for the chiseling removal of toner from the detoning rolls and movement of the toner to a storage area or to the developing station. Further structure associated with and operation of the detoning rolls 114, 120 is discussed in U.S. Pat. No. 4,819,026, the pertinent portions of which are incorporated herein by reference.

It is again stressed that the present invention is not limited in its application to the above described primary cleaning system. For example, in addition to, or in the place of, electrostatic removal of toner and debris by detoning rolls 114 and 120 from brush 100, a cleaner may be provided with mechanical removal of toner from brush 100 and cleaner housing 106 by the application of an air stream and vacuum collection arrangement, wherein a vacuum source (not shown) creates a flow of air through a manifold, which is connected via an opening to the interior of housing 106. Air flow through the housing 106, particularly from the opening of the housing adjacent the photoreceptor 10, entrains and carries toner and debris through the housing and manifold to an output or storage area. The invention also has applicability to alternate cleaning means, including magnetic, insulative and other electrostatic brush assemblies.

As thus described, a reproduction machine in accordance with the present invention may be any of several well known devices. Variations may be expected in specific processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein.

In accordance with one embodiment of the invention, an agglomerate spot cleaning blade 200 for the removal of spot causing agglomerates from the photoreceptor, adhering thereto after cleaning, is located at dirt shield station C in a cleaning position between exposure station B, and developer station D. The spots blade is positioned generally adjacent and parallel to photoreceptor 10, transverse to the process direction 12, and in engagement with the belt surface. An advantage to this location is that gravitational forces are present to aid the spots blade in removing the agglomerate particles.

By way of example, blade 200 may be a thin polyurethane blade, generally about 1 mm in thickness with a durometer of 80 Shore A. Of course, other blade materials, including hard plastics and metals, with different durometers, or greater blade thickness, may work if the edge of the blade can be maintained within the same ranges of angle of attack, load, and interference with the charge retentive surface, as will be described below.

Figure 2:
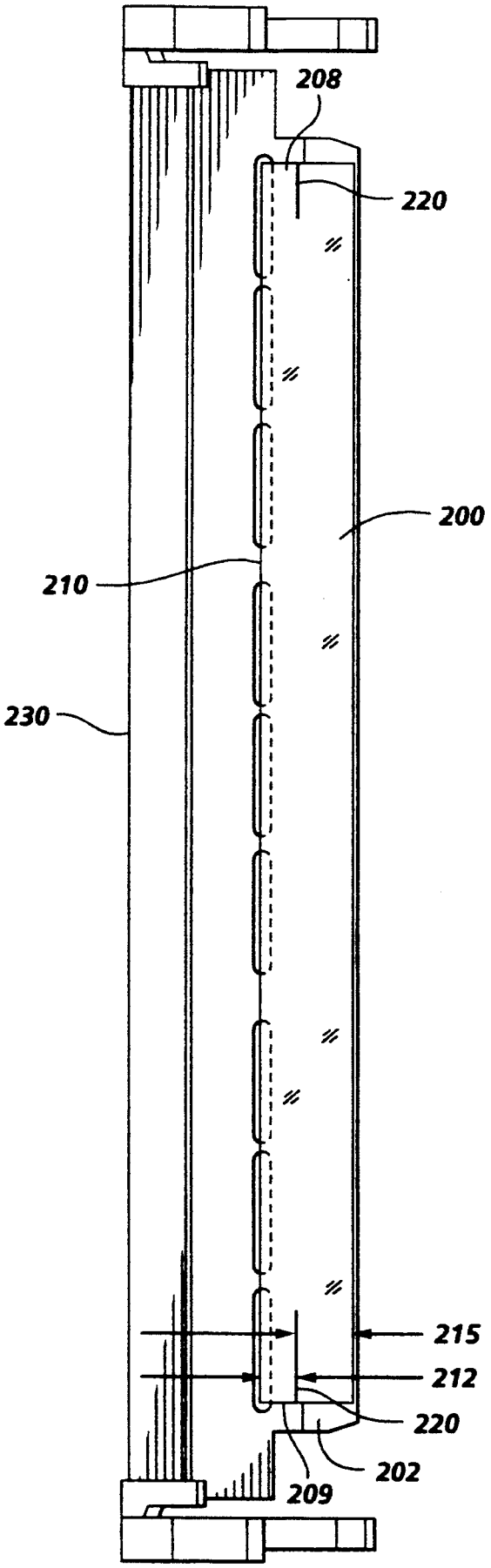
FIG. 2 is an enlarged view of the dirt shield bracket device of FIG. 1, with an embodiment of the blade and blade holder of the present invention.

With reference to FIG. 2, blade 200 has slits 220 extending inwardly from opposed sides 208 and 209 in a direction substantially parallel to free edge 210. These laterally extending slits create a region of increased flexibility on the blade, which substantially prevents the occurrence of blade tuck by reducing forces on the end of the blade where blade tuck is likely to occur and propagate into other areas of the blade member. It is desirable that the benefits of blade tuck prevention obtained from the present invention can be achieved from the agglomerate spot cleaning blade in its original, unaltered material composition. Modifications to the material composition or structural characteristics of the blade to prevent blade tuck, as suggested in the prior art, increase the mechanical complexity and cost of the cleaning assembly. Furthermore, the need to add agents or other foreign substances to the blade to serve as a lubricant is absent in the present invention. The addition of lubricants increases the complexity and introduces compatibility issues to the reproductive assembly, as the lubricating materials eventually dislodge and adhere to the charge retentive surface or other interior components of the machine and may ultimately serve to reduce copy quality or component life.

Slit 220 extends inwardly a distance in the range of between 3 mm and 7 mm, optimally in the range of between 3 mm and 5 mm, and is substantially parallel to the edge of the blade 210. The slit is located a distance 212 ranging between 7 mm and 9 mm from the blade edge 210. The slit separates the free extension of the blade 212 from that part of the blade which is affixed to the blade holder 215. The described position of the slit is for a blade member having a width of about 1.5 cm, where the remaining width of blade member 215, is secured to the blade holder. It is understood that blades of differing widths can be used, and therefore, the position of the slit thereon will vary. However, depending on the blade thickness, it has been found that when a slit is located at a closer distance to the blade edge 210, the blade tends to exhibit excess stiffness, and at a greater distance from the blade edge, blade set is more likely to occur. Furthermore, space limitations may be impeded with blades of greater widths and with slits made at a greater distance from the blade edge. Nevertheless, a greater free extension of the blade can have the advantage of a greater interference with the photoconductive surface (a greater surface area contact) for shearing removal of agglomerate particles.

Blade 200 is mounted on a blade holder 202 adapted to retain the blade in cleaning position. Blade 200 is adhesively secured to blade holder 202, although the actual method of adhering the blade to the holder is not limited to an adhesive.

Figure 3:
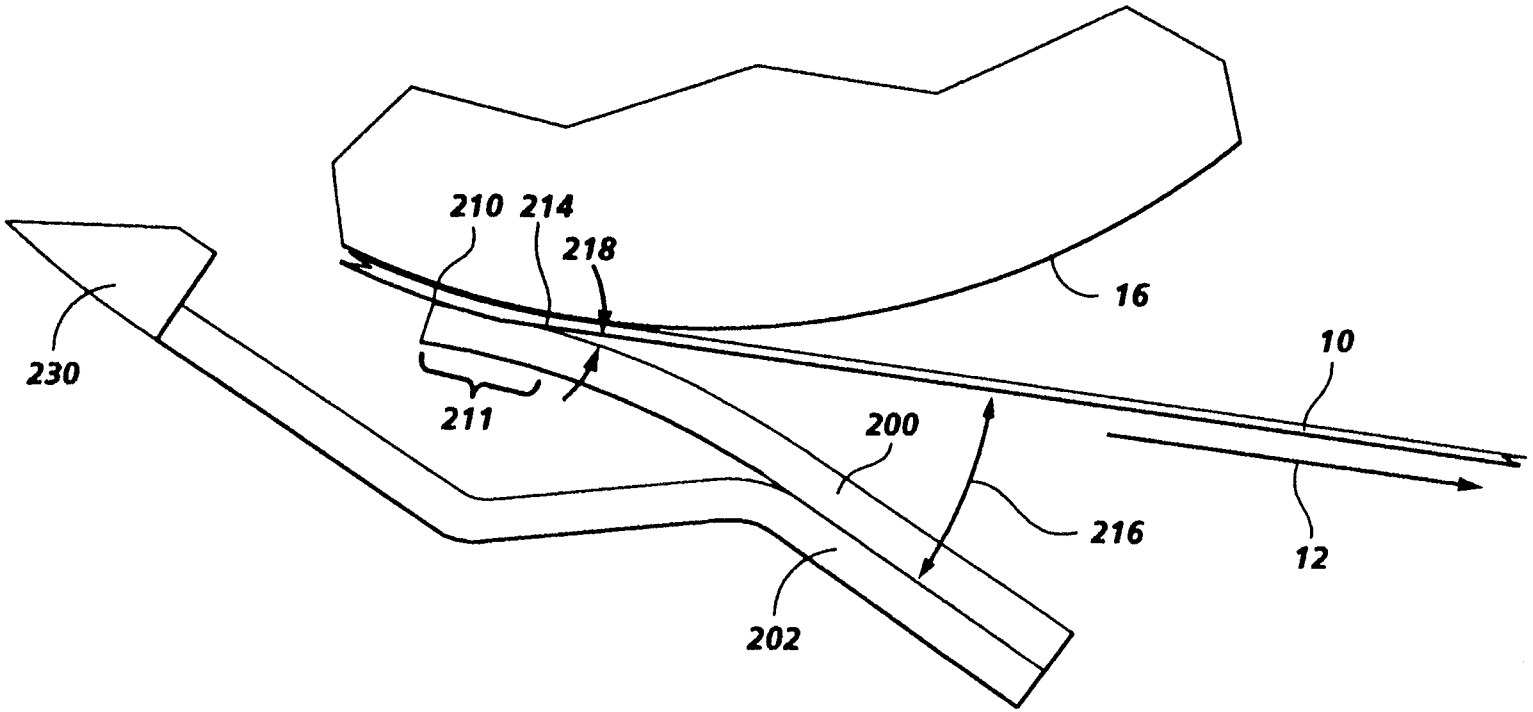
FIG. 3 is an enlarged side view of an embodiment of the blade and blade holder of the present invention, in proximity to the photoreceptor belt.

With reference to FIG. 3, blade holder 202 supports blade 200 at the blade holder angle 216 to provide a low angle of attack 218 (the angle at the contact point 214 of blade 200) with respect to the photoreceptor. The blade holder angle may range from 5° to 45°, while the angle of attack is typically in the range of just greater than 0° to approximately 15° with respect to the photoreceptor. The term "just greater than 0°", should be understood as defining an angle of attack that produces an effect distinguished from that which occurs when the blade is parallel (0°) to the photoreceptor. Additionally, the load on the blade is selected to be relatively low, within the range of just greater than 0 gm/cm to approximately 15 gm/cm and preferably within the range of 2.5–8 gm/cm.

The interference 211 of the blade with the charge retentive belt is the amount of contact the blade surface makes with the belt surface (the distance between blade edge 210 and contact point 214). The desired level of interference within this relatively lower load range is such that, given the angle of attack, an optimal amount of the blade surface is in contact with the charge retentive surface, so that a maximum shearing force can be applied by the blade to the agglomerates for removal thereof, however, before the occurrence of blade tuck. Because the probability of the occurrence of blade tuck and blade set increases as the amount of blade interference increases, the actual interference level is relatively low. In accordance with one embodiment having a 1.27 mm blade thickness, an 8 mm blade extension, and 5 mm slits incorporated on each end, a 1.3 mm interference is found to be optimal.

The range of tolerance of the amount of interference before blade tuck will occur is increased by the presence of slits on the spots blade by up to 40%. This tolerance range is especially important for a blade holder assembly not having a separate spring tensioner mechanism incorporated to ensure minimum tolerances between the blade and photoreceptor surface. In accordance with the embodiment having the blade parameters described above, the tolerance for a 1.3 mm interference of the blade with the photoreceptor belt was found to be +0.5 mm before blade tuck was exhibited, whereas a blade having the same blade parameters but without slits, exhibited blade tucking at 1.3 mm.

Another factor which affects the amount of frictional forces present on the photoconductive surface and therefore the application of blade removal of agglomerate particles is the toner concentration level of the reproductive machine. Machines with lower toner concentration levels generally have higher frictional forces present because of the lower amount of toner present to act as a lubricant. Blade tuck is therefore more likely to occur at a lower toner concentration level.

The factors discussed above, i.e. the blade holder angle, angle of attack, load applied to the blade onto the charge retentive surface, amount of interference of the blade, and toner concentration level of the machine, all impact the amount of frictional forces present between the blade and the photoreceptor surface, and therefore impact the effectiveness of blade cleaning of agglomerate particles. And on prior spots blade assemblies, for obtaining agglomerate particle removal, these factors have been selected to avoid the problems typically associated with the frictional sealing relationship of a cleaning blade with the photoreceptor in the usual blade cleaning relationship where, generally, a higher load is applied to the blade. Thus, it will be appreciated that a slightly greater range of tolerance is provided with the application of these factors to the spots blade of the present invention, for the effective application of agglomerate particle removal without the occurrence of blade tuck. Minor variations from the ranges of these factors, as discussed above, may be acceptable if the functional aspects of the agglomerate cleaning arrangement are retained.

Figure 4:
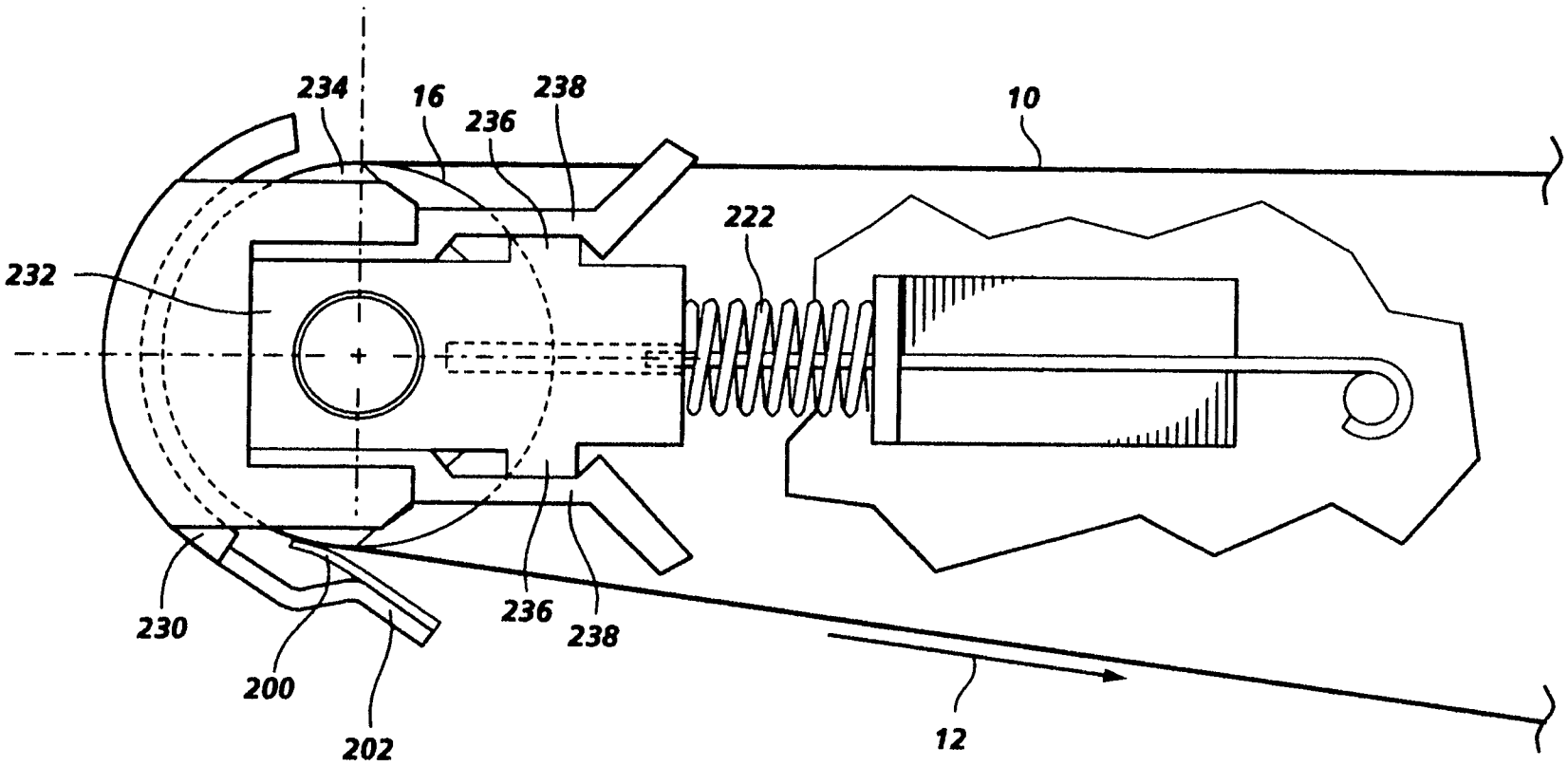
FIG. 4 is an enlarged side view of an embodiment of the dirt shield bracket having the blade and blade holder incorporated therein.

With reference to FIG. 4, the blade and holder are supported on a fixed blade support assembly 230. This assembly consists of a removable bracket 230 which fastens to an edge guide assembly 232. The edge guide assembly is spring loaded 222 and resiliently holds the tension roll 16 to the photoreceptor belt 10. The edge guides 234 on each end of the tension roller 16 serve to keep the photoreceptor belt 10 aligned about the roller 16. Tabs 238 located on the bracket 230 mate with corresponding tabs 236 protruding from the edge guide assembly 232. The agglomerate spot cleaning blade 200 and holder 202 are located inside this bracket 230. The bracket portion of the assembly thus far described is substantially that illustrated and described in the present inventor's publication "Adjustment Free and Easily Removable Spots Blade Bracket," Xerox Disclosure Journal, Vol. 18, No. 4, pp 421–422, July/August 1993.

Mounting the improved agglomerate spot cleaning blade and blade holder on the disclosed assembly has many advantageous features over prior agglomerate spot cleaning blade assemblies. The interconnecting tabs on the bracket and edge guide assembly make the bracket easily removable and interchangeable. Once the parameters for affixing the blade within the bracket relative to the charge retentive surface have been determined, there are no further adjustments or set up required for the blade and holder based on the placement of the bracket onto the spring loaded edge guide assembly. The agglomerate spot cleaning blade does not require a separate spring tensioner or weight to maintain the blade in contact with the charge retentive surface because of preexisting minimum tolerances between the dirt shield bracket and the photoreceptor belt. Furthermore, the blade support assembly has the advantage of saving space, since the agglomerate spot cleaning blade placed within the bracket takes up no additional space than was already used by the bracket in its capacity as a dirt shield. In this assembly, a backup surface is not required to provide support to the blade, as the proximity of the blade and holder to the tension roll provides this. Also, the efficiency of the bracket in its function as a dirt shield is improved, as air and debris from the developer housing are more effectively blocked when the spots blade and blade holder are located within the bracket.

It is understood, however, that the blade and its holder need not be placed within the dirt shield/bracket for the effective removal of agglomerate particles, for example, if space is restricted within the reproduction apparatus, and a dirt shield in proximity to the development station is not in the contemplated design of the machine. The agglomerate spot cleaning blade of the present invention could be supported by a number of various, different housing and support assemblies, and at various locations relative to the charge retentive surface. For example, another such support assembly that is suitable for use with the agglomerate spot cleaning blade of the present invention is the floating support assembly disclosed in U.S. Pat. No. 5,031,000 issued to Pozniakas et al. Such an assembly is loaded with a weight selected to maintain the blade in contact with the charge retentive surface, and floats during break in of a new blade. The benefits obtained from the present invention, however, eliminate the need for the additional and more complex support structure that this free floating blade holder assembly suggests. Other locations about the charge retentive surface that are suitable for placement of the agglomerate spot cleaning blade and holder, include a location slightly downstream (in the process direction) from the cleaning brush 100, and before the exposure station B.

The force that is desirably applied to agglomerates adhering to the photoreceptor 10 by blade 200 is directed approximately parallel to the surface of photoreceptor 10, to create a shearing or chipping force. If the agglomerate adheres to the surface too tenaciously for removal by blade 200, the blade will not readily exhibit the problem of catastrophic tucking failure. The presence of slits on the blade, the ranges of blade loads, interference, and attack angles given above, and their equivalents, allow this characteristic, which would be otherwise undesirable in a blade cleaner. It will be appreciated that due to the relatively lower forces applied to the agglomerate spot cleaning blade assembly, and without the frictional sealing engagement normally used in blade cleaning apparatus, the agglomerate cleaning blade is substantially non-functional for cleaning residual toner.

The blade interference 211 and attack angle 218 at contact point 214 of blade 200, depend on the presence of slits S, the thickness t of the blade, the free extension 212 of the blade L, the blade holder angle BHA 216 and the durometer of the material used for the blade. Thus, for S=5 mm, t=1.27 mm, BHA=15°, and L=8 mm, interference is 1.3 mm, and attack angle is about 10° at a load of about 5.25 gm/cm. In a second case, for S=5 mm, t=1 mm, BHA=30°, and L=10 mm, interference is 2 mm, and attack angle is about 5° at a load of about 10 gm/cm.

A thinner blade with a greater durometer value may be desirable, although a relatively high temperature is associated with the blade contact of the belt, which tends to cause setting in thinner blades of less than 2 mm thickness. Thicker blades tend to have a lower occurrence of blade set, however, a smaller range of tolerance of interference is provided to a thicker blade before blade tuck will occur. Nonetheless, the present invention provides an overall greater range of tolerances to the many factors, as discussed above, that contribute to effective application of an agglomerate spot cleaning blade assembly having either a thicker or a thinner blade.

The proper loading of the blade is a function of the blade normal force and frictions with the photoreceptor. For example, a blade loading of approximately 2.6 to 7 gm/cm is required for the removal of spot causing agglomerate particles, with the nominal force being 5.25 gm/cm, when the toner concentration level is 3½%.

The invention has been described with reference to a preferred embodiment. Obviously modifications will occur to others upon reading and understanding the specification taken together with the drawings. These embodiments are but examples, and various alternatives, modifications, variations or improvements may be made by those skilled in the art from this teaching which is intended to be encompassed by the following claims.

I claim:

1. A printing machine of the type having means for recording a latent image on a surface and means for developing the latent image with toner, wherein the improvement comprises a blade, interposed between the recording means and the developing means, having a free edge adapted to engage the surface to remove at least residual toner therefrom, said blade defining a slit extending inwardly from a side of said blade in a direction substantially parallel to the edge thereof so as to substantially prevent blade tuck.

2. A printing machine according to claim 1, wherein said blade defines a second slit extending inwardly from a side opposed to the one side in a direction substantially parallel to the edge thereof.

3. A printing machine according to claim 1, further comprising a blade holder supporting said blade and placed relative to the surface so that forces on the blade are in the vertical direction and are at a predetermined relatively low load, and presenting a cleaning surface of the blade in interference with and at a low angle of attack with the surface, whereby spot-causing agglomerate particles are shearingly removed from the surface.

4. A printing machine according to claim 3, wherein said blade holder supporting said blade is disposed on the bottommost outer surface of the surface, whereby gravitational forces are present to aid the blade in removing agglomerate particles.

5. A printing machine according to claim 3, further comprising a blade support assembly supporting said blade holder for providing minimum tolerances in engaging the blade with the surface.

6. The apparatus according to claim 5, further comprising a resiliently supported edge guide assembly, for supporting and tensioning the surface.

7. The apparatus according to claim 3, wherein said blade engages the surface with a force ranging from between 0 and 15 gm/cm.

8. The apparatus according to claim 3, wherein said blade interferes with the surface at an optimal level for shearing release of agglomerate particles without the occurrence of blade tuck.

9. The apparatus according to claim 8, wherein said blade interferes with the surface in the range of between 0.3 and 2 mm.

10. The apparatus according to claim 3, wherein the surface of said blade is supported in engagement with the surface at an angle of attack ranging from greater than 0° to approximately 15°.

11. A printing machine of the type having means for recording a latent image on a surface and means for developing the latent image with toner, wherein the improvement comprises a blade, interposed between the recording means and the developing means, having a free edge adapted to engage the surface to remove at least residual toner therefrom, said blade defining a slit extending inwardly from the side of said blade a distance in the range of approximately 3 mm to 7 mm in a direction substantially parallel to the edge thereof so as to substantially prevent blade tuck.

12. A cleaning apparatus for removal of spot causing agglomerate particles from a surface comprising a blade, having a free edge adapted to engage the surface to remove at least residual toner therefrom, said blade defining a slit extending inwardly from a side of said blade in a direction substantially parallel to the edge thereof so as to substantially prevent blade tuck.

13. A cleaning apparatus according to claim 12, wherein said blade defines a second slit extending inwardly from a side opposed to the one side in a direction substantially parallel to the edge thereof.

14. A cleaning apparatus according to claim 12, further comprising a blade holder supporting said blade and placed relative to the surface so that forces on the blade are in the vertical direction and are at a predetermined relatively low load, and presenting a cleaning surface of the blade in interference with and at a low angle of attack with the surface, whereby spot-causing agglomerate particles are shearingly removed from the surface.

15. A cleaning apparatus according to claim 14, wherein said blade holder supporting said blade is disposed on the bottommost outer surface of the surface, whereby gravitational forces are present to aid the blade in removing agglomerate particles.

16. A cleaning apparatus according to claim 14, further comprising a blade support assembly supporting said blade holder for providing minimum tolerances in engaging the blade with the surface.

17. The cleaning apparatus according to claim 16, further comprising a resiliently supported edge guide assembly, for supporting and tensioning the surface.

18. The apparatus according to claim 14, wherein said blade engages the surface with a force ranging from between 0 and 15 gm/cm.

19. The apparatus according to claim 14, wherein said blade interferes with the surface at an optimal level for shearing removal of agglomerate particles without the occurrence of blade tuck.

20. The apparatus according to claim 19, wherein said blade interferes with the surface in the range of between 0.3 and 2 mm.

21. The apparatus according to claim 14, wherein the surface of said blade is supported in engagement with the surface at an angle of attack ranging from greater than 0° to approximately 15°.

22. A cleaning apparatus for removal of spot causing agglomerate particles from a surface comprising a blade, having a free edge adapted to engage the surface to remove at least residual toner therefrom, said blade defining a slit extending inwardly from the side of said blade a distance in the range of approximately 3 mm to 7 mm in a direction substantially parallel to the edge thereof so as to substantially prevent blade tuck.

* * * * *

UNITED STATES PATENT AND TRADEMARK OFFICE

CERTIFICATE OF CORRECTION

PATENT NO. : 5,349,428

DATED : September 20, 1994

INVENTOR(S) : John F. Derrick

It is certified that error appears in the above--identified patent and that said Letters Patent is hereby corrected as shown below:

Claim 6, column 11, line 5, delete "apparatus" and insert --printing machine--

Claim 7, column 11, line 8, delete "apparatus" and insert --printing machine--

Claim 8, column 11, line 11, delete "apparatus" and insert --printing machine--

Claim 9, column 11, line 15, delete "apparatus" and insert --printing machine--

Claim 10, column 11, line 18, delete "apparatus" and insert --printing machine--

Signed and Sealed this

Thirteenth Day of December, 1994

*Attest:*

Bruce Lehman

BRUCE LEHMAN

*Attesting Officer*

*Commissioner of Patents and Trademarks*